US005611194A

United States Patent [19]

Wildmoser

[11] Patent Number: 5,611,194

[45] Date of Patent: Mar. 18, 1997

[54] TUCK ROLLER WITH IMPROVED WEB TENSION CONTROL

[75] Inventor: Martin M. Wildmoser, Florence, Ky.

[73] Assignee: R. A. Jones & Co. Inc., Covington, Ky.

[21] Appl. No.: 338,839

[22] Filed: Nov. 14, 1994

[51] Int. Cl.[6] ..... B65B 43/12; B65B 43/04

[52] U.S. Cl. ..... 53/562; 53/389.4; 226/182; 226/187

[58] Field of Search ..... 53/455, 562, 389.4; 226/181, 182, 183, 184, 187, 188

[56] References Cited

U.S. PATENT DOCUMENTS

| | | | |
|---|---|---|---|
| 3,478,492 | 11/1969 | Cloud et al. | 53/562 X |
| 3,800,993 | 4/1974 | Stephens | 226/187 |
| 3,820,701 | 6/1974 | Clunis | 226/187 X |
| 3,821,873 | 7/1974 | Benner, Jr. et al. | 53/455 X |
| 3,908,979 | 9/1975 | Cloud et al. . | |
| 3,985,277 | 10/1976 | Wright | 226/187 X |
| 4,165,029 | 8/1979 | Mitchell | 226/187 X |
| 4,232,504 | 11/1980 | Dieterlen et al. | 53/562 X |
| 4,242,709 | 12/1980 | Stricker | 226/182 X |
| 4,760,946 | 8/1988 | Bassa | 226/182 X |
| 5,092,103 | 3/1992 | Focke et al. | 53/389.4 X |
| 5,406,775 | 4/1995 | Tacchi et al. | 53/389.4 X |

*Primary Examiner*—Horace M. Culver
*Attorney, Agent, or Firm*—Wood, Herron & Evans, PLL

[57] ABSTRACT

An improved tuck roll apparatus includes a drive roll, backup roll and tuck roll driven by clutch for tensioning and driving a pouch web without slippage on said rolls and for feeding the web to a filler wheel of a pouch filling machine. The tuck roll apparatus drives and tensions the web directly from the vertical sealer and upstream web supply of a pouch forming, filling and sealing machine without requiring any other web drive between the sealer and the filler wheel. All drive slippage is accommodated in the clutch driving the rolls, and not by slippage between the web and the rolls.

13 Claims, 3 Drawing Sheets

TUCK ROLLER WITH IMPROVED WEB TENSION CONTROL

FIELD OF THE INVENTION

This invention relates to tuck rollers and more particularly to tuck rollers for feeding a train of flattened, open-top pouches in web form to the pouch filling wheel of such machines for opening and filling.

This application is related to applicant's copending applications as follows: "Convertible Pitch Pouch Knife", naming Paul E. Dieterlen as inventor; "Variable Count Direct Deposit Knife" by Paul E. Dieterlen; "Convertible Pitch Pouch Machine", naming Frank Oliverio and Boris Makutonin as inventors; and "Low Thermal Inertia Sealer", naming Martin Wildmoser as inventor, all filed on even date herewith and expressly incorporated herein by reference.

In a typical pouch forming, filling and sealing machine, a web is folded on itself and sealed vertically at intervals or "pitches" to define a web train of adjacent open-top pouches separated by vertical seals. From the vertical sealer, the web is threaded through a feed roller assembly including a driven roll or spring-loaded backup roll and a reversing roll to wrap the web about the driven roll's surface though as many degrees as practicable to help obtain a driving grip on the web. This vertically sealed web is introduced by a tuck roller to a filler wheel on which pouches are expanded and filled. The tuck roller is provided with a spring-loaded pinch roller with an inter-meshing gear driven drive from the tuck roller. The web is pushed by the tuck roller/pinch roller nip onto the filler wheel at a predetermined speed higher than the surface speed of the filler wheel in order to permit the opening of the pouches on the filler wheel and at the same time keep the upstream web tight. Thus, the feed roller assembly and tuck roller assembly are provided to work together to feed the web to the filler wheel.

In a typical tuck roller operation, the tuck roller is overdriven. That is, the roller is driven at a speed in excess of that of the web speed. The rollers thus slip on the web surface as they tend to pull it faster than it can go. Back tension is provided, for example, by the first feeder roller assembly, the vertical sealer, or the initial web feed.

Even where a clutch was used in the past, the torque applied by the tuck roller was frequently in excess of its grip on the web, causing slippage and inconsistent web control.

Such typical tuck rollers are thus used to tension or pull the web, and to push it onto a filler wheel where the pouches expand and open for filling. This pushing factor is dependent on the nip force and on the coefficient of friction between the web and the surface of the tuck roller. This coefficient changes due to wear or dirt, thereby varying the slip and the web tension. Web tensions are thus difficult to predict and control due to this slippage. Increasing the pinch force at the tuck roller results in premature and excessive wear of the tuck roll surface and further unpredictable coefficients of friction.

It has thus been one objective of the invention to provide an improved tuck roller for tensioning a pouch web and feeding it onto a filler wheel of a pouch forming, filling and sealing machine.

It has been a further objective of the invention to provide for greater drive predictability and control of a pouch web through a pouch forming and filling process.

it has been a further objective to provide an improved web drive in a pouch machine.

SUMMARY OF THE INVENTION

To these ends, a preferred embodiment of the invention contemplates a tuck roller structure having an overdriven drive roller, driven by a clutch such that any slippage occurs in the clutch and not at the interface between the tuck roller surface and the web. Two spring biased rollers, one a backup roller and one a tuck roller, are driven off the drive roller. These respectively press the pouch web against the drive roller at spaced force nips to wrap the web around the tuck roller, hold it on the tuck roller and feed it onto the filler wheel of the pouch machine. Preferably, the web is wrapped about 180 degrees around the drive roller and somewhat more than 180 degrees about the driven backup roller. Thus, the invention contemplates significant wrap angles and two force nips which combine to positively grip the web without slippage. The positive web control so provided permits elimination of the prior feed roller assembly, the tuck roll structure of the preferred embodiment pulling the web directly from the vertical sealer of the pouch machine with no intervening web drive. This tuck roller structure creates friction on both sides of the web, preventing slippage at the web surface, and produces a high wrap angle around the drive roller and backup roller, all to produce predictable tension in the web.

According to the invention, there is thus no uncontrolled slip and the prior upstream web drive is eliminated. All slippage is accommodated in the clutch, which is, for example, a magnetic particle clutch where all slippage is electronically controlled. The actual tension the improved tuck roller structure is capable of exerting on the web is greater than the load called for by the controllable clutch. This allows predictable web tensions which are not dependent on the slippage between the web and rollers, but are precisely controlled in the clutch. Positive web control and predictable web tensions are thus provided.

Moreover, it will be appreciated that this invention can be effectively used with current pouch machines and with convertible pitch pouch machines by adjusting the position of the tuck roll structure with precise respect to the pouch filler wheel used, but without requiring a change in the position or orientation of the tuck roll assembly drive.

These and other objectives and advantages will become readily apparent from the following detailed description of a preferred embodiment of the invention and from the drawings, in which.

Figure 1:
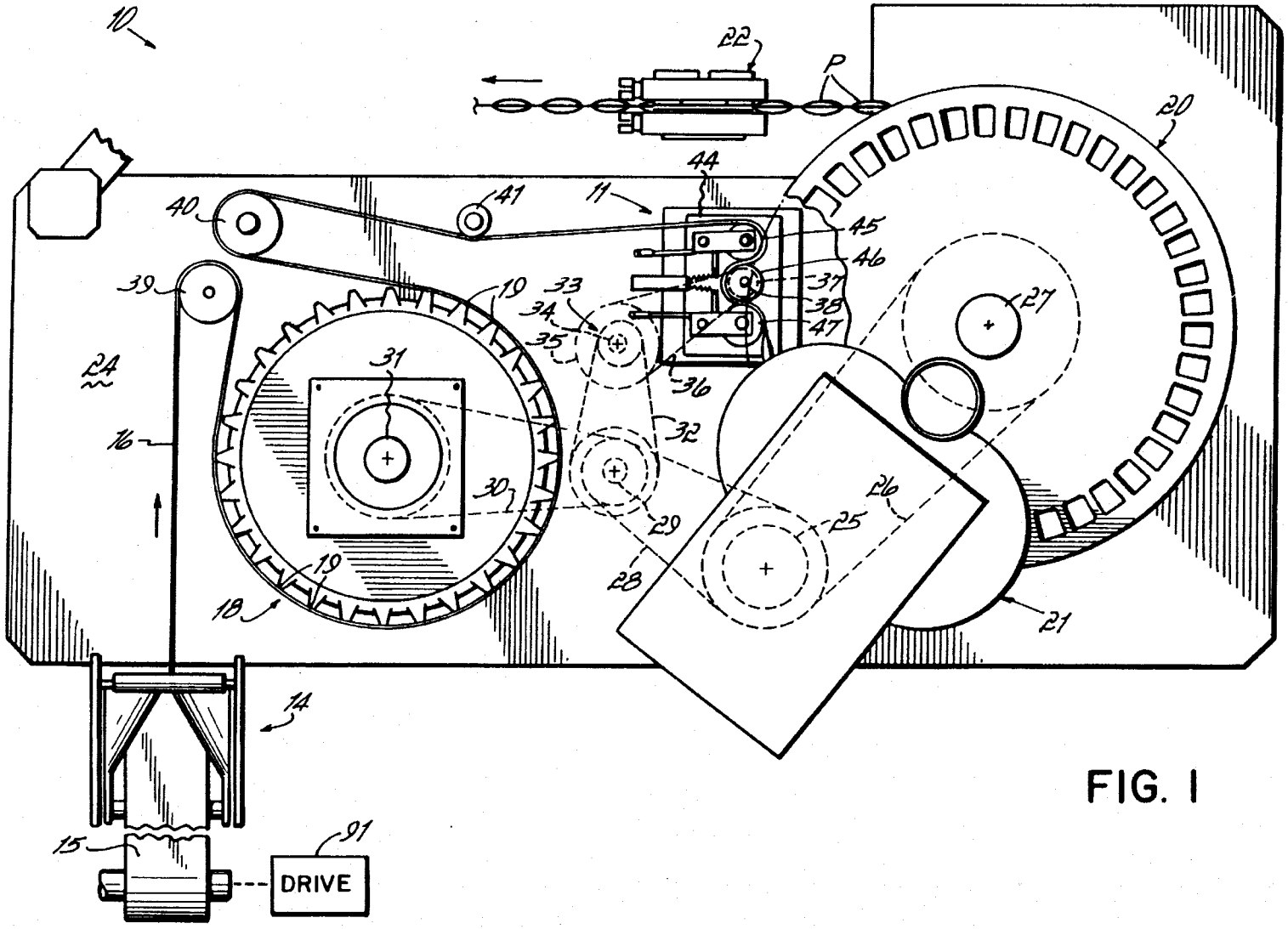
FIG. 1 is a top plan view of a pouch forming, filling and sealing machine according to the invention.

Turning now to the drawings, FIG. 1 illustrates a pouch forming, filling and sealing machine 10 utilizing an improved tuck roll apparatus 11 of this invention. In addition to the tuck roll apparatus, the machine 10 includes a web registration or supply drive 91, a web plough 14 for folding a flat web 15 of pouch material on itself to form a folded web 16, a vertical sealer 18, having a plurality of sealing lands 19 for applying a plurality of vertical seals to the folded web 16 to define a train of open ended pouches, a pouch filler wheel 20 and a top sealer 22. These components are mounted on or adjacent to a machine table top 24, beneath which is located a drive mechanism, as illustrated in schematically dotted lines. The apparatus also includes a filler apparatus 21 for filling pouches P entrained about the filler wheel 20, in any well known manner. In addition, the initial web could be a composite or laminate, for example, of multiple layers.

The drive mechanism includes a major drive shaft 25 driven by a motor (not shown). The drive shaft 25 is connected by a flexible drive belt or chain 26 to the drive shaft 27 of the rotatable filler wheel 20. Shaft 25 is also connected through a flexible drive belt or chain 28 to a jack shaft 29. Jack shaft 29 is connected via a flexible belt or chain 30 to the vertical sealer wheel drive shaft 31. The jack shaft 29 is also connected through flexible belt or chain 32 to a magnetic particle clutch 33 having an input shaft 34 and output shaft 35; each attached to a sprocket or pulley. Shaft 35 is connected through a flexible belt 36 to a drive pulley 37, for example, mounted on drive roller shaft 38 of the tuck roll apparatus 11, as will be further described.

It will be appreciated that any suitable drive linkage can be used for driving the components of the machine 10 and that apart from the further description of the magnetic particle clutch 33 in the tuck roll apparatus 11, these components form no part of the present invention. It will also be appreciated that the drive incorporates either sprockets and chains or pulleys and belts or various operable components thereof, as are desired.

It will be appreciated that the folded web 16 can be entrained about appropriate web guiding pulleys such as pulley or wheel 39, for example, and that the vertically sealed web forming the open ended pouches can also be entrained about additional pulleys, such as those indicated at 40 and 41 in FIG. 1.

It will also be appreciated that various components described above, in and of themselves, comprise no part of the invention apart from the further references to the magnetic clutch 33 and the tuck roll apparatus 11. It will be appreciated, however, that the details of the vertical sealer may be even more readily understood by reference to applicant's co-pending application entitled "Low Thermal Inertia Sealer", naming Martin Wildmoser as inventor, said application being filed on even date herewith, and expressly incorporated herein by reference.

It will also be appreciated that as the pouches leave the top sealer 22, they are introduced to a knife apparatus for cutting the pouches in the seal area between each pouch for packaging or use and that such cutting takes place by means of an appropriate knife, as is suitable. For reference to a particular knife, see applicant's copending applications entitled "Convertible Pitch Pouch Knife", naming Paul E. Dieterlen as inventor, and "Variable Count Direct Deposit Knife" by Paul E. Dieteden, both filed on even date herewith and expressly incorporated herein by reference.

Finally, it will also be appreciated that the tuck roll apparatus 11 may be used with a convertible pitch pouch machine, such as that described in applicant's co-pending application entitled "Convertible Pitch Pouch Machine", naming Frank Oliverio and Boris Makutonin as inventors, filed on even date herewith and expressly incorporated herein by reference. All of said pending applications are herewith incorporated by reference as if fully set forth herein.

Figure 2:
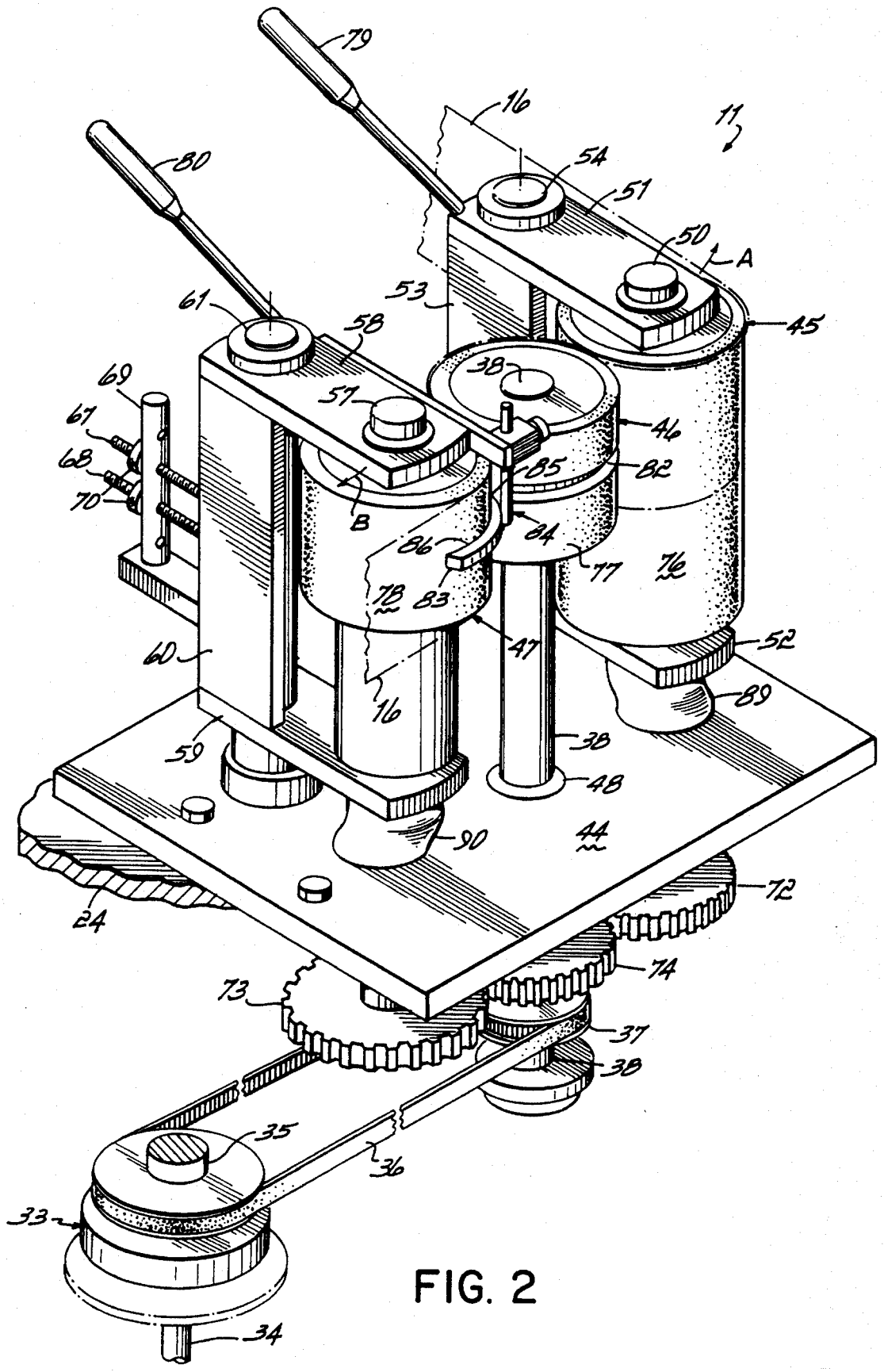
FIG. 2 is a perspective view of a tuck roll apparatus of FIG. 1.
Figure 3:
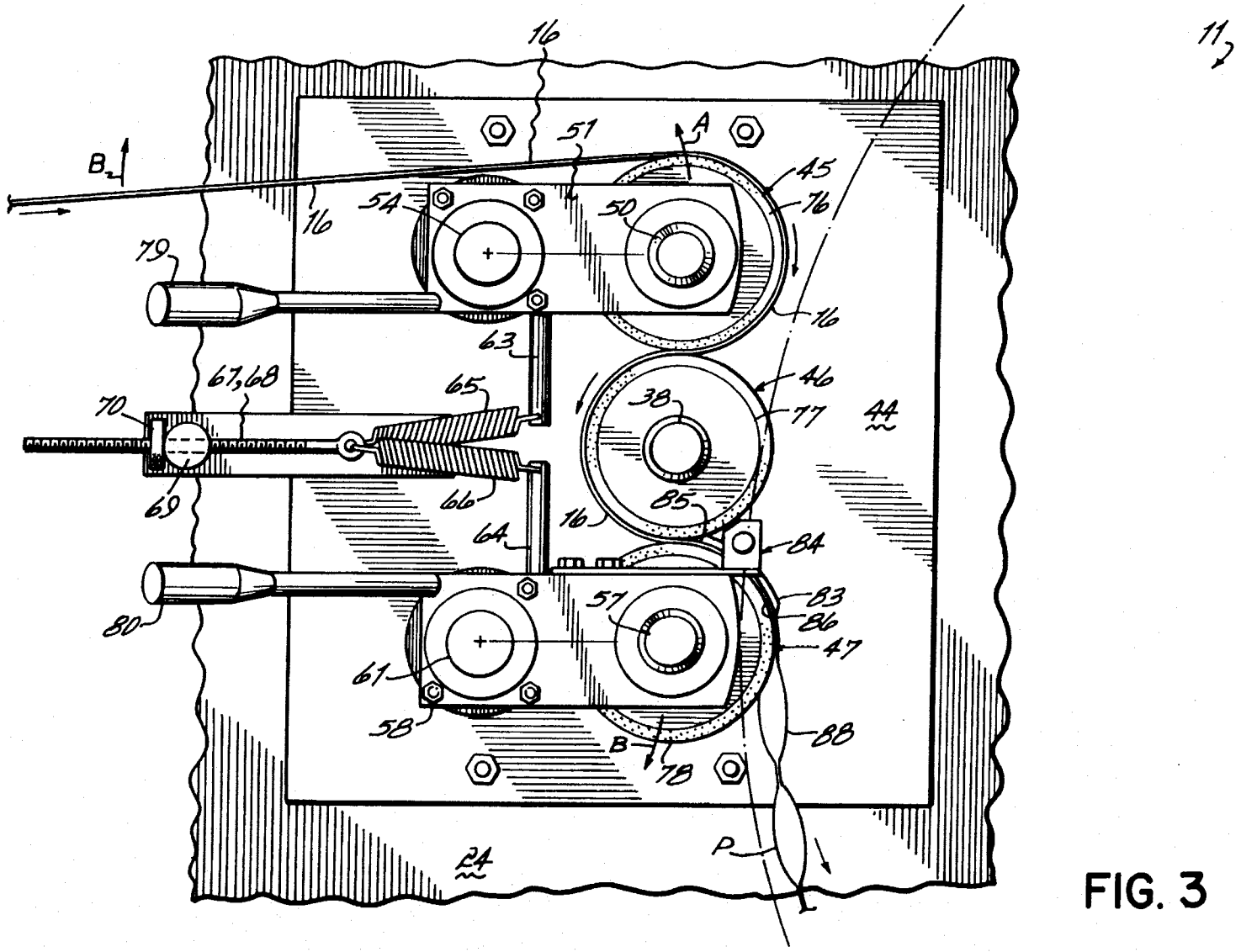
FIG. 3 is an illustrative plan view of the apparatus of FIG. 2.

Turning now to more details of the tuck roll apparatus 11, such details are shown perhaps best in FIGS. 2 and 3. The tuck roll apparatus 11 is mounted on a plate 44 which can be bolted or secured by adjustable means such as slots (not shown) to the table 24 of the machine, for accurate positioning with respect to the filler wheel 20. Tuck roll apparatus includes three rollers, including a backup roller 45, a drive roller 46 and a tuck roller 47. Drive roller 46 is mounted on the drive shaft 38 in a bearing 48, for example. Shaft 38 extends through the plate 44 and downwardly, where it is attached to drive pulley 37. Drive pulley 37 is interconnected with the belt 36, which is also connected to the output pulley 35 of a magnetic particle clutch 33, having an input pulley and shaft 34 and an output pulley and shaft 35. Magnetic particle clutch 33 can be any suitable clutch for controlling the torque applied to the output from a drive interconnected with the input. One preferred clutch is that clutch manufactured by Magnetic Power Systems, Inc. of Fenton, Mo., under the trademark SofStep®. These clutches deliver smooth, controllable and precise torque and engage magnetically with essentially no moving, mechanical parts. Essentially, the primary components of such a clutch include a housing, an electric coil, an input shaft and an output shaft. One shaft, such as the output shaft 35, carries a rotor (not shown) within the housing. The input shaft 34 is formed as a cup (not shown) surrounding the rotor. A gap between the rotor and cup is filled with a dry magnetic powder which is free flowing until a magnetic field is applied from the coil, causing the rotor and output shaft 35 to rotate with the input shaft 34 and cups with, of course, a certain slippage, depending on the control current in the coil and the load on the output shaft. The output torque is controlled by varying the current applied to the coil. When the current is increased, the transmitted torque is increased. Thus, as used in this particular application for example, the rotor and shaft 35 may be driven at one rpm speed with the input shaft 34 at a higher speed in view of the load on the output shaft 35 and the control current delivered to the clutch 33 by the coil. Since the clutch is driven by the main drive from machine 24, sufficient power is available to provide the design force necessary to tension and drive the web.

Back up roller 45 and tuck roller 47 are also mounted to the plate 44. Each of these is mounted in a swing arm apparatus. Back up roller 45 is mounted on a shaft 50 extending between two swing arms 51, 52. These swing arms are mounted by a support member, such as a rectangular, four sided bracket 53, rotationally mounted on fixed pivot shaft 54.

The tuck roller 47 is mounted on a shaft 57, which is carried by swing arms 58 and 59, mounted by a rectangular bracket or support 60 on pivot shaft 61. Pivot shafts 54 and 61 are fixed or secured to plate 44. Arms 51, 52 and 58, 59, with respective brackets 53, 60 are rotatably mounted on fixed shafts 54, 61.

As perhaps best seen in FIG. 3, the brackets 53 and 60 are each provided with respective pins 63 and 64, each pin having one end secured to its respective swing arm assembly and having a free end each of which is connected to a respective spring such as at 65 and 66. The ends of the spring are mounted to an adjusting bolt 67 mounted in an upstanding member for support 68. By means of adjusting nut 69, the bolt 67 can be extended or retracted and thereby increase or decrease tension in the spring 65 and 66. An increase in the tension springs 65, 66 will increase the bias imparted by the springs to the swing arms 51, 52 and 58 and 59, respectively, so as to swing the shafts 50 and 57 generally toward one another and toward the shaft 38. Thus, the tension in spring 65, 66 is operable to urge the backup roll of 45 toward the drive roll of 46 and the tuck roll of 47 also toward the drive roll of 46, thus forming two force nips for capturing and driving the web, and insuring a wrap of about 180 degrees about the drive roller 46.

On the lower end of the shaft 50 is mounted a gear 72 while a similar gear 73 is mounted on the lower end of shaft 57. A drive gear 74 is mounted on the lower end of shaft 48 for the drive roll 46. It should be appreciated that the gear 72 meshes with gear 74 as does the gear 73. Accordingly, when the pulley 37 is driven through the magnetic clutch 33 the shaft 38 and gear 74 is turned. Gear 74 thus drives the gears 72, 73 and respective shafts 50 and 57. Accordingly, each of the rollers 45, 46 and 47 is mounted on its respective shaft for rotation as those shafts are driven, and each of the rollers is thereby driven. Holes are provided in plate 44 large enough to accommodate lateral movement of shafts 50, 57.

It will be appreciated that the drive roll 46 and the backup roller 45 and tuck roller 47 are covered with a sheath, sleeve or coating of a resilient material such as urethane (black, 60 A durometer) or any other suitable coating. These coatings are identified by the respective numbers 76, 77 and 78 and are preferably resilient relative to the metallic or harder rollers on which they are mounted. The overall diameter of rolls 45, 46 and 47, including that of the sleeves thereon is such that the teeth of gears 72, 73 always mesh with those of gear 74 when the system is driving a web, but the teeth do not fully engage so as to limit the actual force applied by rollers 45, 47 toward roller 46 and any web therebetween by virtue of springs 65, 66. It will also be appreciated that the diameter of sleeved rollers 45, 47 and resilience is such that the teeth always mesh when the system is operating as noted above Thus the full range of force represented by springs 65, 66 is available for application to a web without limitation thereof by gear engagement.

It will also be appreciated that each of the brackets 53 and 60 are provided with respective handles 79 and 80 for the manual rotation of the respective assemblies outwardly away from the drive roller 46 to facilitate threading of a web 16 there around as will be described.

It will further be appreciated that at least outer covering 77 on drive roll 76 is provided with a groove 82. A web guide 83 is supported by a bracket 84 and has an upstream end 85 disposed in the groove 82. The web guide has an inner surface 86 for receiving and guiding the web 16.

It will be appreciated that the filler wheel 20 is provided with a series of pockets such as at 88, together with other mechanisms such as vacuum cups (not shown) for receiving individual pouches of the folded and vertically sealed pouch web 16. The pouches are expanded at least partially for filling as shown by the pouches in FIG. 3. It will also be appreciated that as the web 16 approaches the tuck roll structure 11 it first is entrained about the backup roller 45 which presses the web 16 against the drive roller 46. It will be appreciated that the web 16 is preferably wrapped about the backup roll about 188 degrees, slightly over 180 degrees. If this wrap were significantly less, i.e. were the web to be fed at a lesser angle such as indicated by arrow B, FIG. 3, the take-off angle of entering web 16 may act adversely to the nip force applied by spring 65 and may negate that force, in the least tending to cancel it.

Thereafter, the web 16 is wrapped about the drive roller 46 and in one embodiment about 180° where the web then is engaged by the outer coating 78 on the tuck roller 47 and is also thus pressed against the drive roller 46. Other wrap angles can be used. Thereafter, the web is stripped from the drive roller 46 by means of the web guide 83 riding in the groove 82 on the drive roller 46. The web is guided away from the drive roller 46 onto the filler wheel 20 and positioned for opening with the covering 78 of the tuck roller serving to press the web onto the filler wheel 20 for receiving the web and for expanding it into the open pouches P by vacuum or by some other means.

The web 16 is readily threaded into the tuck roll apparatus by manipulation of the handle 79 to rotate the backup roller 45, for example, in the direction of the arrow A, FIG. 2, away from the drive roller 46 to open a space between the two rollers and allow for the threading therein. Likewise, the handle 80 is manipulated to rotate the tuck roller 47 in the direction of arrow B away from the drive roller 46 so that the threading of the web can be continued about the drive roller 46 and between the tuck roller 47 and the web guide 83. As will be appreciated elastic tubular covers 89 and 90 may be utilized to cover the drive shafts 50 and 57 to prevent dust and debris from falling through the table plate 44.

It will be appreciated in use that as the machine 10 is operated it drives the magnetic particle clutch 33 to input a rotational force to the rollers 45, 46, and 47. Due to the pressures exerted upon the rollers by means of the springs biasing the rollers 45 and 47 against the drive roller 46, and due to the web wrap angles, the web entrained therebetween is securely wrapped about the drive roller 46, and backup roller 45, which serves to positively grip the web and to transport the web in a linear direction toward the filler wheel 20 without any slippage between the drive roller 46 and the web. This exerts tension on the web which is resisted, for example, only by the vertical sealer 18 or by the web supply drive 91 for example. Thus, the tuck roll apparatus 11 is utilized to sufficiently tension the web and to pull it with an appropriate tension into the tuck roll apparatus 11 and thereafter to drive it onto the filler wheel at a predetermined speed. In order to accomplish this, the magnetic particle clutch 33 is controlled so as to exert a predetermined torque on the web which tends to tension the web appropriately and to drive it at the appropriate speed, controlled by the registration or supply roller drive 91, against any system friction or back tension. Slippage occurs in the clutch as a function of input rotation, output load and control current. There is no slippage between the web 16 and the rollers 45,46 and 47. Thus, the tuck roll apparatus 11 controls the tension of the web to drive it at a speed which is somewhat in access of the peripheral speed of the filler wheel 20 in order to supply sufficient folded web material 16 to the filler wheel 20 in order that the pouches P may be opened on the wheel.

It will be appreciated that the opening of the pouches on the filler wheel 20 causes the consequential shortening of the web across those open pouches. That is to say that when the pouches are open, the chord between the seals in each of the pouches is somewhat shortened, thereby shortening the web along the pouches and requiring the web to be driven at a sufficient speed in order to appropriately index with the filler wheel 20. The linear speed of the web 16 then at the tuck roll apparatus, is somewhat greater than the peripheral speed of the filler wheel in order to accommodate this partial fore-shortening.

It will be appreciated that any slippage between the web drive represented by the tuck roll assembly 11 and the web 16 is accommodated within the magnetic particle clutch 33 and is not accommodated by any slippage between the web 16 and any of the rolls 45, 46 or 47. Thus, the web tension and speed is maintained more consistently than if that tension relied on, or was somehow a function of, any slippage between the web itself and the surface of any drive or prior tuck roller. The bias of the rollers 45 and 47 toward the drive roller 46, together with the substantial wrap of the web 16 about at least 180° of the drive roller 46, and 180 degrees plus of the backup roller 45 secures this positive engagement of the web with the drive so that the slippage can be controlled in a positive and predetermined manner by the electronic control of the magnetic particle clutch. It will be appreciated that the potential extent of the frictional grip of the tuck roll apparatus 11 on the web is in excess of the load applied to the web by the magnetic clutch drive 33 so that within a given predetermined driving range, the web is precisely driven and controlled, all slippage having been taken up in the clutch. 0f course, after the pouches are filled on the filler wheel 20 by any known suitable means, the pouches are passed to the top sealer 22 which seals the tops of the open pouches. Thereafter, the web train of pouches is introduced to a knife which cuts the pouches apart along the vertical seals for further cartoning or shipping use.

It will be appreciated that the tuck roll apparatus as described herein can be utilized with a convertible pitch pouch machine with the controllable clutch being utilized to adequately maintain the appropriate torque and web tension on the folded web 16 as it is supplied to the filler wheel 20 from the vertical sealer and the web supply. It will also be appreciated that a drive takeup or mounting system for plate 44 could be utilized in conjunction with the belt 36, for example, so that the apparatus 11 mounted on plate 44 could be moved laterally with respect to the filler wheel should that be rendered necessary by a pitch change or any filler wheel size change, and without any change in the drive beneath the machine table 24.

Finally, it will also be appreciated that the utilization of the tuck roll as disclosed herein eliminates the need for any other preliminary or inline web drive separate from the tuck roll structure 11, all while improving the web control tension and rendering the operation of the web drive more consistent.

These and other modifications and advantages will become readily apparent to those of ordinary skill in the art without departing from the scope of this invention, and the applicant intends to be bound only by the claims appended hereto.

We claim:

1. Tuck roll apparatus for a pouch filling machine having a filler wheel for filling a web of open-end pouches, said tuck roll apparatus comprising:

a drive roller defining a pouch web path extending about 180 degrees around said drive roller;

a backup roller oriented for pressing a web of open-ended pouches against said drive roll and defining a pouch web path extending more than about 180 degrees around said backup roller;

said backup roller defining a web nip with said drive roller;

a tuck roller for pressing said web against said drive roll at a wrap angle and for carrying said web to said filler wheel;

said tuck roller defining a second web nip with said drive roller;

a clutch for applying a torque to said drive roller for driving said drive roller at a speed to drive said web, said torque being in excess of that required to drive said web at said speed for applying a tension to said web; and wherein the drive roller, backup roller and tuck roller drive the pouch web at a predetermined tension without slippage between said pouch web and said rollers.

2. Apparatus as in claim I wherein said clutch is a magnetic particle clutch for imparting a torque to said drive roller for applying a tension to said web.

3. Apparatus as in claim 1 wherein said backup and tuck rollers are mounted on respective axes movable toward and away from said drive roller and further including an adjustable force for urging said backup and tuck rollers respectively toward said drive roller at said web nips.

4. Apparatus as in claim 1 including springs for urging said backup and tuck roll against said drive roll, said springs being adjustable to vary the force at which the backup and tuck rollers are urged toward said drive roll.

5. Apparatus as in claim 1 wherein said clutch is set to drive said drive roll for pulling said web and creating a tension therein.

6. Apparatus as in claim 1 including a web guide extending about a portion of said tuck roll for guiding a pouch web onto a filler wheel.

7. Apparatus as in claim 1 wherein said pouch filling machine has a vertical sealer, and wherein a pouch web is disposed between said sealer and said tuck roll apparatus with said web tucking apparatus directly pulling said web from said sealer.

8. Tuck roll apparatus for a pouch filling machine having a filler wheel for filling a web of open-end pouches, said tuck roll apparatus comprising:

a drive roller defining a pouch web path extending about 180 degrees around said drive roller;

a backup roller oriented for pressing a web of open-ended pouches against said drive roll and defining a pouch web path extending more than about 180 degrees around said backup roller;

said backup roller defining a web nip with said drive roller;

a tuck roller for pressing said web against said drive roll at a wrap angle and for carrying said web to said filler wheel;

said tuck roller defining a second web nip with said drive roller;

a clutch for applying a torque to said drive roller for driving said drive roller at a speed to drive said web, said torque being in excess of that required to drive said web at said speed for applying a tension to said web;

wherein the drive roller, backup roller and tuck roller drive the pouch web at a predetermined tension without slippage between said pouch web and said rollers; and wherein said backup and tuck rollers are mounted on respective axes movable toward and away from said drive roller and further including an adjustable force for urging said backup and tuck rollers respectively toward said drive roller at said web nips, and further including a drive gear driven with said drive roller, a respective drive shaft for each of said backup and tuck rollers and a driven gear on each of said drive shafts, said driven gears operably intermeshing with said drive gear for all operative positions of said backup and tuck rollers with respect to said drive roller and a pouch web thereabout.

9. Tuck roll apparatus for a pouch filling machine having a filler wheel for filling a web of open-end pouches, said tuck roll apparatus comprising:

a drive roller defining a pouch web path extending about 180 degrees around said drive roller;

a backup roller oriented for pressing a web of open-ended pouches against said drive roll and defining a pouch web path extending more than about 180 degrees around said backup roll;

said backup roller defining a web nip with said drive roller;

a tuck roller for pressing said web against said drive roll at a wrap angle and for carrying said web to said filler wheel;

said tuck roller defining a second web nip with said drive roller;

a clutch for applying a torque to said drive roller for driving said drive roller at a speed to drive said web, said torque being in excess of that required to drive said web at said speed for applying a tension to said web;

wherein the drive roller, backup roller and tuck roller drive the pouch web at a predetermined tension without slippage between said pouch web and said rollers;

including a web guide extending about a portion of said tuck roll for guiding a pouch web onto a filler where; and further including a groove in said drive rollers, an upstream end of said guide disposed in said groove.

10. Tuck roll apparatus for a pouch filling machine having a filler wheel for filling a web of open-end pouches, said tuck roll apparatus comprising:

a drive roller defining a pouch web path extending about 180 degrees around said drive roller;

a backup roller oriented for pressing a web of open-ended pouches against said drive roll and defining a pouch web path extending more than about 180 degrees around said backup roller;

said backup roller defining a web nip with said drive roller;

a tuck roller for pressing said web against said drive roll at a wrap angle and for carrying said web to said filler wheel;

said tuck roller defining a second web nip with said drive roller;

a clutch for applying a torque to said drive roller for driving said drive roller at a speed to drive said web, said torque being, in excess of that required to drive said web at said speed for applying a tension to said web;

wherein the drive roller, backup roller and tuck roller drive the pouch web at a predetermined tension without slippage between said pouch web and said rollers; and wherein said clutch has an input side rotationally driven by a machine drive, and an output for driving said drive roller at a different speed at a predetermined torque.

11. A pouch forming, filling and sealing machine of the type having a vertical web sealer for applying seals in said web to form pouches in said web, a tuck roll and a filler wheel, and further including a clutch operably connected for applying a torque to said tuck roll and driving said tuck roll;

said tuck roll positively engaging said web without slippage between said tuck roll and said web, and said tuck roll oriented to push said web directly onto said filler wheel.

12. A machine as in claim 11 further including a drive roll and a backup roll in combination with said tuck roll for engaging and driving said web without slippage of said web on said rolls, said rolls tensioning and pulling said web directly from said vertical sealer.

13. A machine as in claim 12 further including a clutch for applying a torque to said drive roller for driving said drive roller at a speed to drive said web, said torque being in excess of that required to drive said web at said speed for applying a tension to said web.

* * * * *